United States Patent [19]

Dakin, Jr. et al.

[11] 3,942,689

[45] Mar. 9, 1976

[54] APPARATUS FOR REMOVING COMPACTED FIBROUS MATERIALS FROM CONTAINERS

[75] Inventors: Gerald Frank Dakin, Jr., Milan, Mich.; Georges Louis Olney, Danville; Desmond Patrick Robertson Smyth, Asbestos, both of Canada

[73] Assignee: Johns-Manville Corporation, Denver, Colo.

[22] Filed: Feb. 27, 1974

[21] Appl. No.: 446,181

Related U.S. Application Data

[63] Continuation of Ser. No. 347,017, April 2, 1973, abandoned, which is a continuation of Ser. No. 147,911, May 28, 1971, abandoned.

[52] U.S. Cl. ..... 222/195

[51] Int. Cl.[2] ..... B65G 3/12; B65G 69/06

[58] Field of Search ..... 222/193, 195; 302/56, 57; 259/4, DIG. 17; 210/219, 319

[56] References Cited

UNITED STATES PATENTS

| | | | |
|---|---|---|---|
| 2,025,404 | 12/1935 | Stahn | 222/125 X |
| 2,115,023 | 4/1938 | Kennedy | 302/56 X |
| 2,303,458 | 12/1942 | Hermann | 222/193 X |
| 3,777,912 | 12/1973 | Deeks | 302/56 X |

*Primary Examiner*—Robert B. Reeves
*Assistant Examiner*—Francis J. Bartuska
*Attorney, Agent, or Firm*—Robert M. Krone; John H. Miller

[57] ABSTRACT

An apparatus and a method are disclosed for loosening compacted fibrous material in a container whereby the fibrous material will flow freely out through an outlet located in the bottom of the container. Agitation means are provided on the sidewalls of the container adjacent to the outlet to create and maintain an open space adjacent the outlet. A flexible, tubular member is placed in said container so that a free portion having an open end extends into the open space a sufficient distance that when a pressurized fluid is passed through the flexible member and out of its open end it causes whip-like movements of the free portion within the open space causing the pressurized fluid to be directed upwardly towards the fibrous material compacted overhead to loosen and dislodge the fibrous material.

1 Claim, 8 Drawing Figures

INVENTORS
GERALD F. DAKIN, JR.
GEORGE L. OLNEY
DESMOND P. SMYTH

BY John A. McKinney
ATTORNEY

FIG. 5
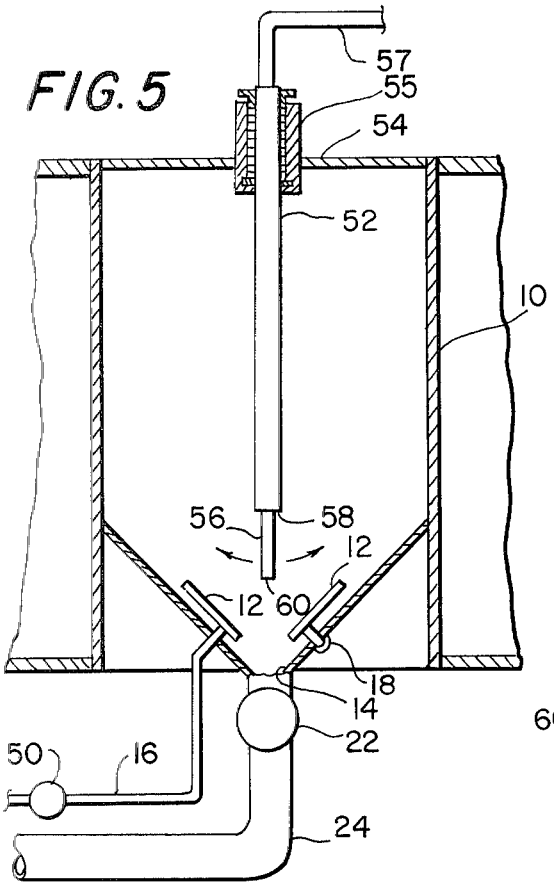
FIG. 6
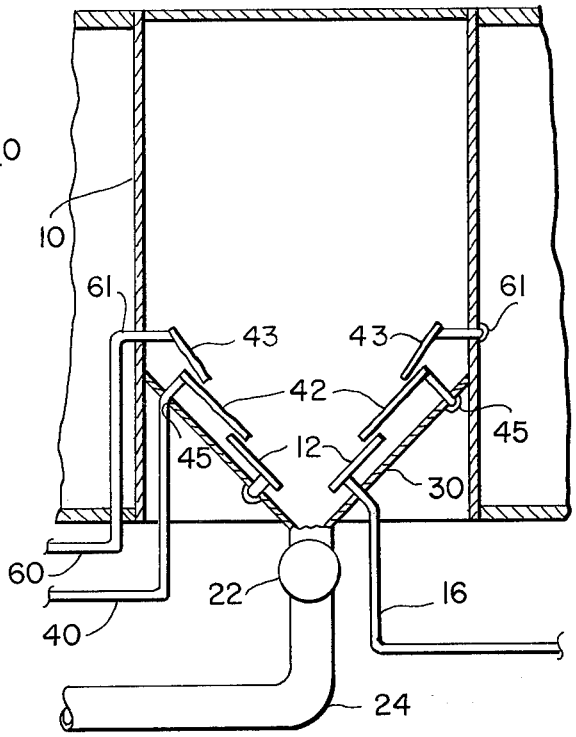
FIG. 7
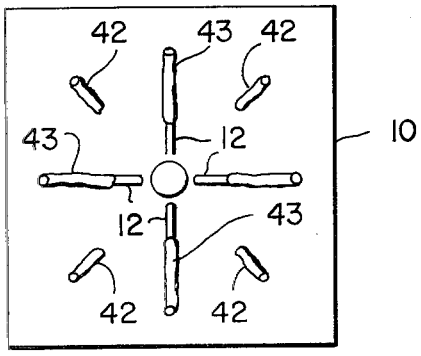
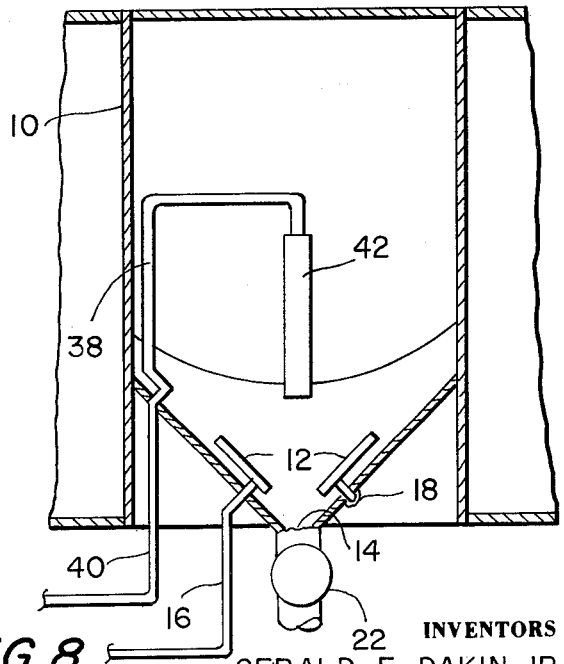
FIG. 8
INVENTORS
GERALD F. DAKIN, JR.
GEORGE L. OLNEY
DESMOND P. SMYTH
BY John A. McKinney
ATTORNEY

APPARATUS FOR REMOVING COMPACTED FIBROUS MATERIALS FROM CONTAINERS

This is a continuation of application Ser. No. 347,017, filed Apr. 2, 1973 now abandoned which was a continuation of application Ser. No. 147,911 filed May 28, 1971 and now abandoned.

BACKGROUND OF THE INVENTION

1. Field of the Invention

The present invention relates to a method and apparatus for dispensing solid materials and more particularly to a new and improved method and apparatus for dispensing fibrous or fiber-like materials from containers.

2. Discussion of the Prior Art

Fibrous materials, such as asbestos fibers or other similar solid materials are being shipped in Pressure-Flow tank cars made for rail transport of dry bulk products. Each of the tank cars is divided into a plurality of inverted cone-shaped compartments or containers and the various containers are unloaded by introducing a compressed fluid, such as air, into the containers. The air pressure developed within the containers forces the aerated fibers out of the bottom of the cone of the containers and into pipes through which the fibers are blown into storage silos.

Although such arrangements have proved to be advantageous compared to manual unloading procedures, they have not proven entirely satisfactory under all conditions of service because considerable difficulty in unloading has been experienced due to compaction of the fibers in transit. This compaction has made it especially difficult, if not impossible, for compressed air emitted from fixed nozzles to completely loosen all of the fibers within the container. Frequently, the fibers compact into a bridge-like form within the container that prevents a significant proportion of the fibers from being unloaded. As a result, the expensive and time-consuming procedure of manually scraping and loosening the fibers remaining in the container has been necessary to ensure the complete evacuation of the fibers from the container.

OBJECTS OF THE INVENTION

It is, therefore, a primary object of the present invention to provide a new and improved method and apparatus for efficiently dispensing solid materials from shipping containers.

Another object is to provide a new and improved method and apparatus for dispensing fibrous materials from inverted, cone-shaped containers wherein the apparatus is simple and rugged in construction, is highly efficient in breaking down bridging of the fibrous materials in the containers, and can be readily installed in existing containers.

Additional objects and advantages of the invention will be set forth in part in the description which follows, and in part will be obvious from the description, or may be learned by practice of the invention.

SUMMARY OF THE INVENTION

To achieve these objects and in accordance with its purpose, this invention provides a simply constructed and inexpensive apparatus that ensures complete evacuation of compacted solids, including fibers, from a container having a discharge outlet. The invention works in conjunction with agitating means positioned adjacent the outlet for discharging a portion of the material adjacent the discharge opening and creating an air space. The invention comprises conduit means for introducing pressurized fluid into the container, and at least one flexible, hollow, tubular member located within the container and having one end connected to said conduit means for passing pressurized fluid to the interior of the tubular member and then out of the tubular member and into the container.

Preferably, the conduit means include at least one rigid pipe mounted within the container for introducing pressurized fluid to the interior of said tubular member, and the agitation means includes at least one fixedly positioned aerating nozzle mounted within the container for passing pressurized fluid directly into the container.

The invention also includes a method of loosening compacted solid material to enable substantially complete evacuation of the material through a discharge outlet of a container. The solid material adjacent the discharge outlet is agitated to discharge a small quantity of material from the container and form an opening within the container above the outlet. One end of a flexible tubular, whip-like member is fixed within the container with the other end of the whip-like member being free to move through the opening created by the initial agitation step. Pressurized fluid is introduced through the flexible member and into the container to cause whip-like movements by the flexible member and the discharge of fluid from said tubular member onto varying portions of the solid material whereby complete evacuation of the solid materials from the container through the discharge outlet can be accomplished.

BRIEF DESCRIPTION OF THE DRAWINGS

The accompanying drawings illustrate examples of several embodiments of the invention and together with the description serve to explain the principles of the invention.

In the drawings:

FIG. 5 is a diagrammatic elevation, partly in section, of still another embodiment of the invention.

FIG. 6 is a diagrammatic elevation, partly in section, of still another embodiment of the invention.

FIG. 7 is a diagrammatic plan view of the embodiment illustrated in FIG. 6; and FIG. 8 is a diagrammatic side elevation, partly in section, of another embodiment of the invention.

DESCRIPTION OF THE PREFERRED EMBODIMENTS

Figure 1:
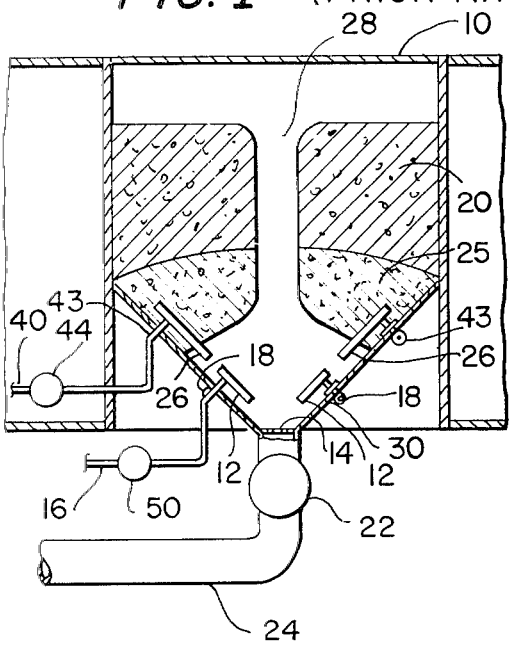
FIG. 1 (PRIOR ART)
FIG. 1 is a diagrammatic elevation, partly in section, of a prior art shipping container for fibrous material.
Figure 2:
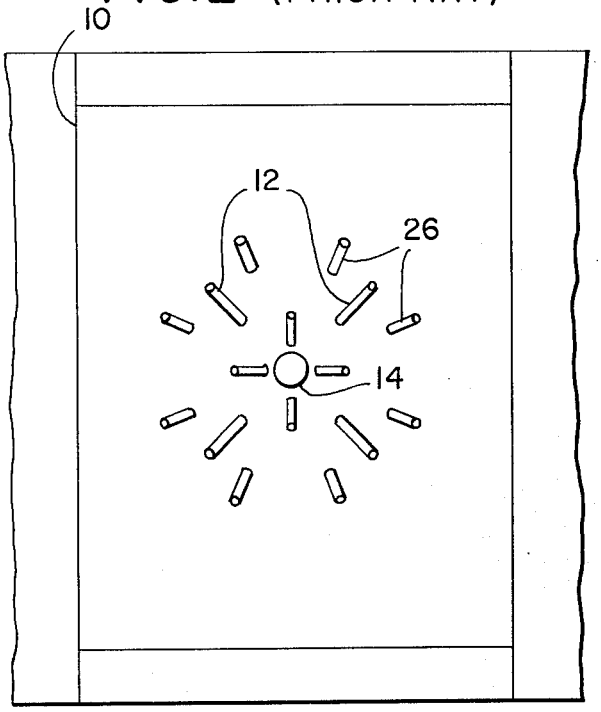
FIG. 2 (PRIOR ART)
FIG. 2 is a diagrammatic top plan view of the container of FIG. 1.

With reference to the drawings, wherein like characters designate like or corresponding parts throughout the several views, there is shown in FIGS. 1 and 2 a conventional inverted cone shipping container 10 for transporting solid materials, such as asbestos fibers and the like. FIG. 1 illustrates the configuration that a fibrous material 20 frequently takes after air under pressure is used to attempt to discharge the container. A plurality of aeration pipes 12 are located within the container and along the lower portions of the interior walls of the inverted conical shape which converges to a discharge outlet 14. A plurality of upper aeration pipes 26 are located along the upper portions of the interior walls of the inverted conical shape. A supply pipe 16 is coupled to a header 18 so that compressed fluid, such as air, can be forced through pipe 16 into lower aeration pipes 12 spaced around the sloping side of the container, and out through suitable apertures (not shown) in aeration pipes 12.

The aeration of material 20 within the container and the pressure created by the air within the container force some of the material down and out through outlet 14. A valve 22 is connected in series with outlet 14 for controlling the flow of material from container 10, through piping 24 to a desired destination, such as a storage silo (not shown). Containers 10 are formed by compartmentalizing a Pressure-Flow tank car designed for transport of dry bulk products.

Experience has shown that vibration during transport of fibrous material 20 causes the material to settle within the containers and to compact to a relatively rigid state, particularly in the bridged area indicated at 25 in FIG. 1. The introduction of compressed air into container 10 through the lower bank of aeration pipes 12 always succeeds in evacuating the bottom portion of container 10 which is formed by the walls of cone 30. However, once the lower ends of the upper bank of aeration pipes 26 are exposed, the pressure created by the air causes a central hole 28 to develop through material 20, as illustrated in FIG. 1, leaving the remaining material hung up or bridging on the sides of the container, as illustrated at 25. As a result, it has been necessary to manually scrape or shovel the material at 25 into the lower portion of the cone before it could be discharged from the container.

Figure 3:
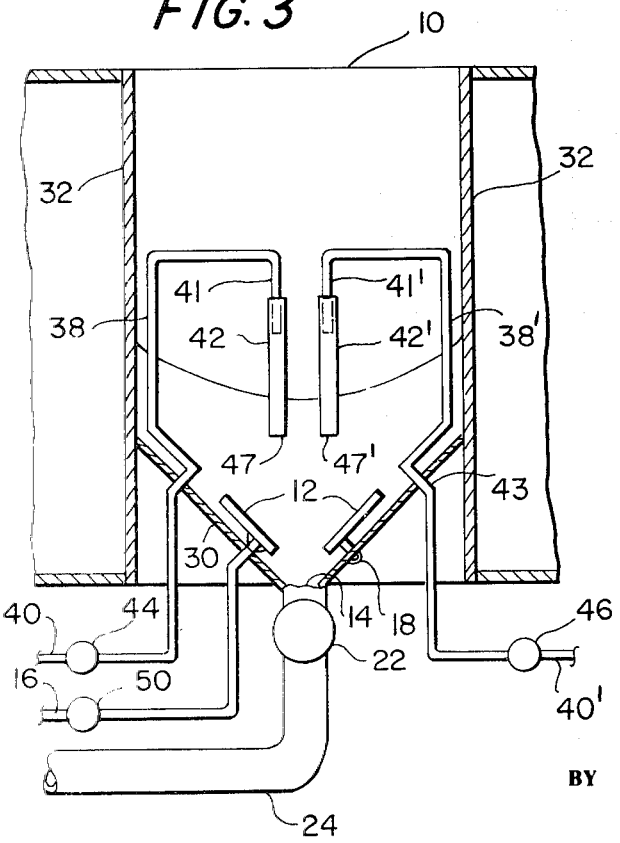
FIG. 3 is a diagrammatic elevation, partly in section, of a shipping container and showing one embodiment of the present invention.
Figure 4:
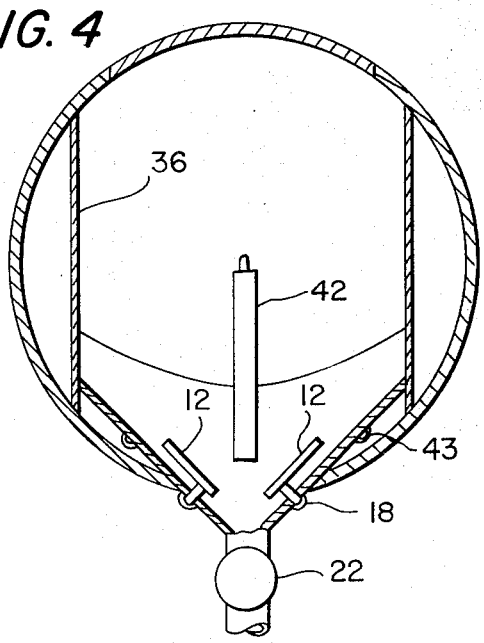
FIG. 4 is a diagrammatic end elevation, partly in section, of FIG. 3.

As best shown in FIG. 3, the present invention provides an efficient apparatus and method that eliminates hang-ups and bridging of the material and ensures complete evacuation of the solid material from container 10 through discharge outlet 14.

Agitation means are provided for dislodging a portion of the solid materials positioned adjacent the discharge outlet of the container. The agitation means permit the dislodged material to flow from the container and help create an air space adjacent the discharge outlet. The agitation means can be selected from a variety of mechanical devices or pneumatic arrangements that are well-known in the art.

As illustrated in the embodiment of FIG. 3, the agitation means comprise a plurality of aerating pipes 12 which direct streams of pressurized air at the material in the bottom of container 10. Pneumatic pressure generated by the introduction of pressurized air from nozzles 12 causes solid material positioned adjacent outlet 14 to be discharged through the outlet.

A supply pipe 16 is connected to a header 18 so that compressed air, can be forced through pipe 16, into aeration pipes 12, spaced around the sloping sides of the container, and out through suitable apertures (not shown) in aeration pipes 12. The aeration of material 20 within the container and the pressure created by the air within the container force some of the material down and out through oulet 14. A valve 22 is connected in series with outlet 14 for controlling the flow of material from container 10, through piping 24 to a desired destination, such as a storage silo (not shown).

Conduit means are provided for introducing pressurized fluid into the container. In preferred embodiments, the conduit means also function as a fixed means on which one end of a flexible tubular member is mounted. As illustrated in the embodiment of FIG. 3, the conduit means comprise pipes 38 and 38′ which introduce pressurized fluid from supply lines 40 and 40′ into the container. The end portions 41 and 41′ of pipes 38 and 38′ are vertically aligned and are positioned above discharge outlet 14. As here embodied, the conduit means also includes separate valves 44 and 46 which are located on fluid supply lines 40 and 40′, respectively, to control the supply of compressed air to a pair of flexible whip-like members 42 and 42′ (discussed below).

In accordance with the invention, a flexible, hollow, tubular and whip-like member is located within the container. One end of the tubular member is connected to the conduit means to fix the position of this end and to permit passage of fluid from the conduit means to the interior of the tubular member. When pressurized fluid is passed into and through a flexible member mounted as described above, with one end fixed and the other completely free to move, the flexible member moves like a whip.

It is believed that at least three factors contribute to the surprisingly effective displacement results that are achieved: (a) the flexible tubular member achieves a large area of coverage due to its whip-like motion; (b) the pneumatically applied force caused by the compressed fluid emitted from the tubular member; and (c) the mechanical shearing action of the exterior of the moving tubular member as it contacts the solid material.

As illustrated in the embodiment of FIG. 3, a pair of flexible tubular members 42 and 42′ are provided. The upper end of the tubular members are connected to the end portions 41 and 41′ of the pipes, while the lower end of the tubular members are free to move in all directions in reaction to gas emitted from their free end. Preferably, and as illustrated in FIG. 3, only a single discharge opening 47 or 47′ is provided at the end of each tubular member for passing air into the container. The use of a single end opening helps provide a strong blast of air for dislodging the solid material and for exerting a strong reaction force on the tubular member.

The tubular members 42 and 42′ must be flexible and should be abrasion resistant. A wide variety of elastomeric materials can be used to form the tubular members including natural rubber; various synthetic rubbers, and various linear or cross-linked synthetic organic plastic materials such as polyvinyl chloride and polypropylene. Preferably, the tubular members are cylindrical with an annular cross-section and have inside diameters of from ½ inch to 1 inch and outside diameters of from 1 inch to 1¾ inch. However, it should be understood that for unloading some materials an irregular outer wall surface for the tubular member is sometimes desirable.

Flexible members 42 and 42′ desirably have an outside diameter of from 1 inch to 1¾ inch and an inside diameter of from ½ inch to 1 inch and a length of about 6 feet. The desired length, diameter, and material of construction of the flexible members varies with the size of the container to be evacuated and the number of flexible members utilized, the characteristics of the material being conveyed and the conveying fluid. For example, when a single substantially centrally located flexible, whip-like member, as shown in FIG. 8 is provided, the flexible member must be long enough to reach all portions of the material that tend to compact, and the inside diameter of the member should allow passage of a large enough volume of air to create whipping action and provide mechanical and pneumatic shear.

In the operation of the apparatus of FIG. 3, container 10 is initially filled with a solid material such as asbestos fibers and the material is transported to a desired destination. During transportation, the material is compacted by vibration. When evacuation of the compacted material from the container is desired, compressed air is introduced into container 10 by opening valve 50 on fluid supply pipe 16 to agitate and aerate material positioned directly above outlet 14. Then valve 22 is opened and material is discharged from container 10. An air space is thus produced above outlet 14.

Valves 44 and 46 in pipes 40 and 40′ are opened. The passage of high-pressure air through pipes 38 and 38′ and into flexible, whip-like members 42 and 42′ and the discharge of gas from the free end of these members cause whip-like action by the flexible members so that they rapidly move about within the container. The whip-like members exert direct shearing forces on the compacted solid material and at the same time direct a high-pressure air stream at varying angles and at different portions of the surface area and the mass of the compacted solid material. This combination of rapid whip-like movement of members 42 and 42′ into contact with the compacted fibers together with the flow of compressed air over almost all portions of the surface of the compacted fibers dislodges and fluidizes the fibers and enables the desired evacuation of the fiber material from the container through discharge outlet 14. The high-pressure air introduced by pipes 12 and flexible members 42 and 42′ creates a high pressure within the container. Flow of air from the container to a low pressure zone carries the dislodged solid material from the container.

Another embodiment of the invention is illustrated in FIG. 5. A substantially rigid, hollow, tubular guide member 52 extends through the upper wall 54 of container 10 in an air-tight sealed relationship which permits vertical movement of member 52 relative to wall 54. Preferably, member 52 slides relative to wall 54 and a conventional stuffing box 55 or mechanical seal provides the seal. Member 52 is vertically aligned above discharge outlet 14. The upper end of tubular member 56 is axially mounted on a supply line 57 in fluid flow communication therewith. Member 56 extends coaxially down rigid member 52 with the bottom end 60 of member 56 extending into container 10 beyond the lower end 58 of the rigid member and being free to move. A sealing ring of nylon or the like interconnects member 52 and flexible tubular member 56 to prevent escape of gas up the interior of member 52 and to permit member 52 to slide vertically with respect to flexible tubular member 56. Compressed air passes through supply line 57 into member 56 and then passes out end 60.

In the embodiment of FIG. 5, agitation means comprising aeration pipes 12 are provided for creating an opening above outlet 14.

The passage of compressed air through tube 56 causes the free end 60 to rapidly move about within the container in a whip-like motion. As the material around tube end 60 is dislodged, the free length of tube end 60 is increased by sliding member 52 upward. Continuing the whipping action of tube end 60 dislodges compacted materials from increasing heights in the container. Similar results can be achieved by withdrawing both member 52 and tube 56 upwardly so the free length of tube end 60 remains constant.

Still another embodiment of the invention is illustrated in FIGS. 6 and 7 in which eight flexible members are installed along the interior wall of the conical portion 30 of container 10. A first group of four flexible members 42 are spaced apart substantially 90° from each other, as best seen in FIG. 7, and are located at a first level along the side of conical portion 30. A second group of four flexible members 43 are located adjacent the interior wall of container 10 at a position above members 42. Flexible members 43 are also spaced substantially 90° from each other and are offset from the lower series of members 42 by about 45°.

As in the previously described embodiment, aerating pipes 12 are positioned adjacent the discharge opening. Air is supplied to lower flexible whip-like members 42 via fluid pipes 40 and header 45 while a separate air supply 60 and header 61 provide compressed air to upper flexible members 43.

The operation of this embodiment is similar to the previously described embodiments. Air is forced directly into container 10 through fluid supply pipe 16 and aerating members 12, and at the same time, compressed air is forced through flexible members 42 and 43. The passage of compressed air through the flexible members causes them to move in a whip-like manner to physically contact the fibrous material within the container while at the same time directing a flow of compressed air over almost all portions of the surface of the fiber within the container. As a result, the container is successfully evacuated.

This invention provides an efficient apparatus for effectively dispensing solid materials from a container and particularly for effectively dispensing fibrous materials which tend to compact within the container due to vibration during transportation.

The invention in its broader aspects is not limited to the specific details shown and described and departures may be made from such details without departing from the principles of the invention and without sacrificing its advantages.

What is claimed is:

1. In an apparatus for dispensing compacted fibrous material from a container having a discharge outlet and a sloping sidewall adjacent to said outlet, said sloping sidewall having fixed nozzles mounted thereon for loosening the material in the portion of the container adjacent said sloping sidewall, comprising conduit means for introducing pressurized fluid into the container, and at least one flexible, hollow, tubular member connected to said conduit means, said at least one flexible, hollow, tubular member having a free portion and an open end and being of sufficient length to extend said open end into the portion of the container adjacent said nozzles a sufficient distance to cause a whip-like movement of said free portion when said pressurized fluid is passed therethrough whereby said fibrous material compacted above said open end is loosened for removal from said container, the improvement comprising:

a vertically extending tubular guide member, said guide member being slideably mounted on a top wall of the container in sealing relationship with the top wall, with said flexible tubular member extending along said guide member and slidably mounted within said guide member in sealing relationship with the interior wall surface of said tubular guide member to permit varying the elevation of said guide member and thus varying the exposed length of said flexible tubular member.

* * * * *